United States Patent [19]

Kourkene

[11] 3,960,995

[45] June 1, 1976

[54] METHOD FOR PRESTRESSING A BODY OF CERAMIC MATERIAL

[76] Inventor: Jacques P. Kourkene, 27057 Horseshoe Lane, Los Altos Hills, Calif. 94022

[22] Filed: Apr. 17, 1972

[21] Appl. No.: 244,977

Related U.S. Application Data

[63] Continuation of Ser. No. 37,417, May 13, 1970, abandoned, which is a continuation of Ser. No. 639,532, May 18, 1967, abandoned.

[52] U.S. Cl. ..... 264/27; 29/447; 29/452; 29/469.5; 264/61; 264/66; 264/228; 264/231

[51] Int. Cl. ..... B28b 23/04

[58] Field of Search ..... 264/25, 27, 61, 66, 264/60, 228, 229, 231, 327, DIG. 46; 29/447, 452, 472.9; 52/227, 223, 230

[56] References Cited

UNITED STATES PATENTS

| | | | |
|---|---|---|---|
| 1,960,120 | 5/1934 | Mohring | 264/DIG. 46 |
| 2,061,105 | 11/1936 | Ruml | 25/118 |
| 2,319,105 | 5/1943 | Billner | 264/228 X |
| 2,325,469 | 7/1943 | Boissou | 25/118 |
| 2,609,586 | 9/1952 | Parry | 264/228 X |
| 2,727,293 | 12/1955 | Barnett et al. | 264/229 |
| 2,794,481 | 6/1957 | Anderson | 18/45 UX |
| 3,290,197 | 12/1966 | Carmody | 156/175 X |

FOREIGN PATENTS OR APPLICATIONS

| | | | |
|---|---|---|---|
| 666,712 | 2/1952 | United Kingdom | 25/118 |

*Primary Examiner*—Jan H. Silbaugh
*Attorney, Agent, or Firm*—Flehr, Hohbach, Test, Albritton & Herbert

[57] ABSTRACT

Thermal prestressing methods using unit and selective heating of tendons incorporated in a ceramic or cermet body to selectively elongate the tendon with respect to the body and soften the latter. Upon cooling an anchorage bond is formed between the body and the ends of the tendons, which bond develops a tension in the tendon and prestress in the body upon further cooling. Bodies are also prestressed by forming a bond between the tendon and the body and then heating the body in use so as to elongate the tendon relative to the body, the tendon having a greater coefficient of expansion than the material of the body.

33 Claims, 9 Drawing Figures

INVENTOR.
JACQUES P. KOURKENE
BY
Flehr, Hohbach, Test, Albritton & Herbert
ATTORNEYS

INVENTOR.
JACQUES P. KOURKENE

BY Flehr, Hohbach, Test, Albritton & Herbert
ATTORNEYS

METHOD FOR PRESTRESSING A BODY OF CERAMIC MATERIAL

CROSS REFERENCE TO RELATED APPLICATIONS

The present application is a continuation of applicant's earlier filed application Ser. No. 37,417, filed May 13, 1970, which application was a continuation of applicant's originally filed application Ser. No. 639,532, filed May 18, 1967, both now abandoned.

BACKGROUND OF THE INVENTION

This invention relates to a method of prestressing materials, particularly brittle materials such as ceramics including refractories, heavy clay products and pottery. The invention is generally applicable to other materials, such as cermets, whose structural properties can be improved by the prestressing method disclosed herein.

Heretofore, the conventional techniques for applying mechanical prestress to concrete structures have been attempted with ceramic materials. However, such techniques have not proven entirely satisfactory since ceramics are usually subjected to extreme service conditions such as high temperatures in which such conventional prestressing techniques are inadequate. In other cases the cost and difficulty of mechanically prestressing such materials has been excessive. There is, therefore, a need for a new and improved method for prestressing ceramic materials and products.

SUMMARY OF THE INVENTION

It is a general object of the present invention to provide a method for prestressing ceramic and cermet materials and product which will overcome the above mentioned limitations and disadvantages.

Another object of the invention is to provide a method of the above character particularly applicable to ceramics to render them structurally useful at high temperatures for prolonged periods.

Another object of the invention is to provide a method of the above character which does not require exterior reinforcing elements in the finished product.

Another object of the invention is to provide a method of the above character which is particularly convenient to carry out and which can be accomplished either before or after the ceramic has been formed and fired.

Another object of the present invention is to provide a method for making a product of the above character which has enhanced mechanical properties which permit it to be used under extreme temperature conditions such as in refractory uses, hypervelocity vehicles, spacecraft, nuclear reactor parts and further in which a reduction of failure due to brittleness and an increase in the flexibility and stress capacity of the product is achieved.

Another object of the invention is to provide a method of the above character which utilizes tendons such as wires, rods or stranded wires which apply stress to the material and which are able to resist high temperatures and retain the useful structural properties over long periods of time.

In accordance with the above objects, there is provided a method for prestressing a body of material which consists of bonding an elongate tendon into a body of a brittle material under thermal conditions by which differential thermal expansion or contraction is created between the tendon and the body, the thermal expansion or contraction causing the body to become prestressed. The method generally consists of embedding an elongate tendon in a region of the body of brittle material to be prestressed and heating at least the tendon to cause it to longitudinally expand a greater amount than the body and to a temperature sufficient to cause the portion of the body surrounding the tendon to attain a temperature in excess of softening or fusion. Thereafter the region of the body surrounding the tendon together with the tendon are cooled so that the fused portion bonds the body to the tendon. As the region and tendon further cool, a tension is developed in the tendon through the anchorage bond at its ends. This tension is transferred to the body as compression through the bond that has been formed. Unit heating of the body and tendon and selective heating of the tendon can be used.

The present invention is characterized by the type of bond that is developed between the tendon and the body. This bond is used to place the body in prestressed condition and is accordingly referred to as a stress developing, anchorage bond and uses shear forces exerted at the bond interface between the tendon and the body being prestressed.

The prestressed product formed by the method of the invention consists of a body of material in which there is embedded one or more elongate tendons. Each tendon is made of a material having suitably high strength at the service temperature of the finished product. The tendon is thermally elongated and then bonded along its length to the body by the aforementioned method. For temperatures below the service temperature of the product, the tension in the tendon is transferred by the shear forces between the tendon and the body into a compressive force on the body.

The above and further objects and features of the invention will become apparent from the following description and claims when taken in conjunction with the accompanying drawings.

DESCRIPTION OF THE DRAWINGS

Referring to the drawings.

DETAILED DESCRIPTION

Selective Heating Method

Figure 1A:
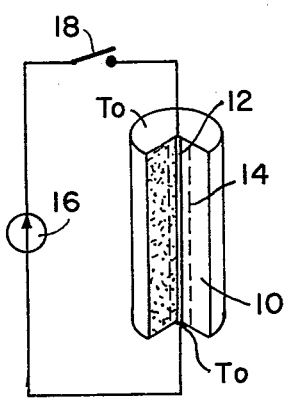
FIGS. 1A, 1B and 1C are diagrammatic views illustrating one method of forming a prestressed product according to the invention in which the tendon is selectively heated.
Figure 1B:
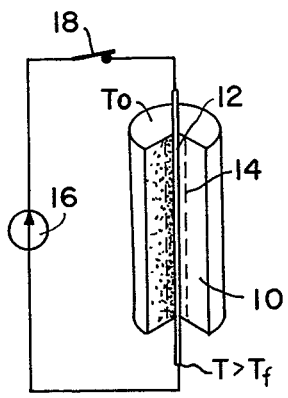
Figure 1C:
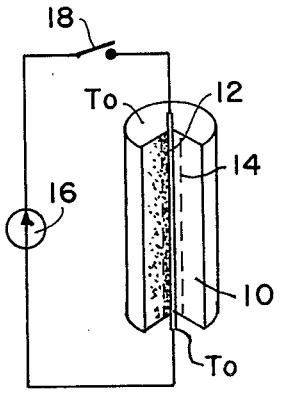
Figure 2A:
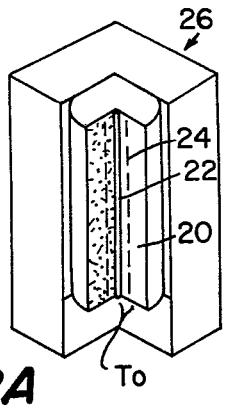
FIGS. 2A, 2B and 2C are diagrammatic views illustrating another method for forming a prestressed product according to the invention in which the body and the tendon are heated as a unit.

Referring to FIGS. 1A through 1C, the selective heating method for producing a thermally prestressed body of material is illustrated. Thus, there is provided a body 10 of material such as ceramic. An elongate tendon is disposed in a region 14 of the body 10. The method requires that the region 14 immediately surrounding the tendon 12 be heated to the fusion temperature. Accordingly, as shown in FIG. 2A the tendon 12 is made of conductive material and is connected to suitable means for heating it such as a current source 16 through switch 18. Alternatively, the tendon can be heated by a high-frequency induction current.

The tendon is selectively heated such as by closing switch 18 to current source 16 and passing a sufficiently high electric current through the tendon (FIG. 1B) to heat the region 14 to softening or fusion temperatures. As the tendon is heated and the region softens, the tendon elongates due to its coefficient of expansion so that upon cooling and resolidification of region 14, a bond is established between the tendon 12 and the ceramic body 10. The bond is established quickly and well before the tendon cools since the heat of the tendon is conducted radially away from it and into the surrounding body. By further cooling as shown in FIG. 1C, the tendon 12 is placed in greater and greater tension because of the bond and causes a corresponding compression or prestress to be developed in the body 10.

It will be noted that the tendon need not have a greater coefficient of expansion than the body 10. It is only required that it expand and become bound to the fused region 14 upon cooling. In fact, in high service temperatures it is desirable that the tendon have comparable or lower coefficient of expansion than the body so that prestressing will be relatively maintained or increased.

In order to reduce the risk of cracking or breakage of the ceramic body during the period when the tendon is heated, the entire body and tendon can be incorporated in an oven or furnace and the temperature of the body and tendon raised together prior to the application of the electric current. Thereafter, the ceramic is allowed to cool to an ambient temperature while the current continues to maintain the tendon at a high temperature, to maintain the region surrounding the tendon in a softened or fused condition. Subsequently, the current is disconnected and the tendon cooled to set up the prestress previously explained.

Unit Heating Method

Figure 2B:
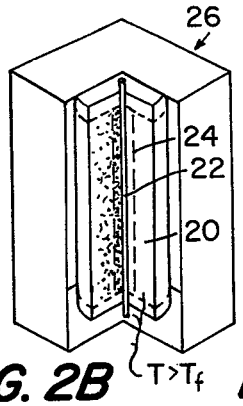
Figure 2C:
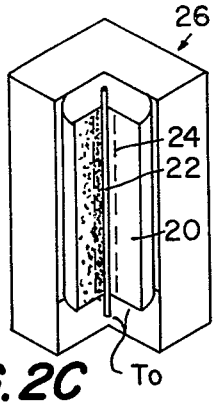

Referring to FIGS. 2A through 2C, there is illustrated the method of forming the prestressed body by heating or firing the body and tendon as a unit. Thus, in FIG. 2A there is provided a body 20 of material, such as ceramic, having an elongate tendon 22 disposed in a region 24 of the body. The body 20 and tendon 22 are enclosed in a firing furnace 26. In FIG. 2A both the tendon and the body of material to be stressed are at ambient temperatures. FIG. 2B shows the expansion of the body 20 and the tendon 22 after the entire unit has been raised to the firing temperature of the ceramic.

The tendon 22 must be selected to have a greater coefficient of expansion than that of body 20 but need not be conductive. As the temperature is increased, the tendon 22 elongates by a greater amount than the expansion or elongation of the body 20. During the firing period the body is heated to a temperature above fusion of region 24 and the apparatus is permitted to cool. As the body and tendon are cooled the resolidification of the ceramic causes a bond to be formed between the tendon and the body. Thereafter further cooling and contraction of the tendon and the body cause the latter to be put in compression. As shown in FIG. 2C, the body has returned substantially to its initial length but the tendon remains stretched in tension due to the bond with the region 24 of the body.

Since the amount of prestressing depends upon relative thermal elongation, the tendon material should be selected so that its coefficient of thermal expansion is sufficiently greater than that of the material of body 20 to achieve a given amount of prestress. The greater the difference, the more efficient the prestressing will be on cooling. Under conditions of high temperature service some prestressing will remain and the full prestressing will be restored upon cooling.

Anchorage Bond Development

Figure 3:
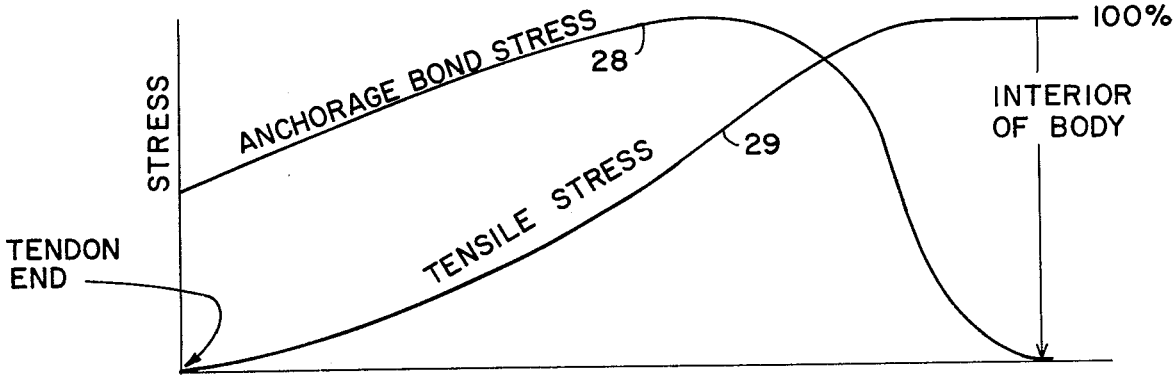
FIG. 3 is a graph of the anchorage bond or shear stress at the end of the tendons and the total stress in the tendon as a function of the length from one end which results from the prestressing methods of the invention.

Using the above methods there is developed a stress bond between the tendon and the region of ceramic immediately surrounding the tendon. Referring to FIG. 3, there is shown graphs depicting the anchorage bond stress 28 and the tensile stress 29, shown as a function of the length of the tendon from one end. As shown, the anchorage bond stress (shear) increases to a maximum and then falls to zero after the maximum tensile stress is achieved. Not indicated is the flexural bond stress which develops along the tendon under loads that may be applied to the body in use. Such flexural bond stress does not contribute to prestressing the body.

Prestressed Plate in Two Dimensions

Referring to FIG. 3 there is shown a body 30 of ceramic material in which there is embedded a plurality of wires or tendons 32, 33 extending in two intersecting directions. The body 30 and tendons 32, 33 are assembled together, as shown, and then processed by either the selective heating method or the unit heating method as hereinbefore described. After heating and cooling, the body is prestressed by the tendons in the respective directions in which the tendons extend by fusion and resolidification of the regions 34, 35 surrounding the tendons 32, 33 causes the development of an anchorage bond at the ends of the tendons and results in the plate becoming prestressed in the directions in which the tendons extend.

By way of example, the following materials and calculations are pertinent to the plate as shown in FIG. 3 in which body 30 is made of mullite and tendons 32, 33 are made of tungsten. Coefficient of elasticity of tungsten = 60,000,000 psi, approximately, lower as temperature rises. Tensile strength of wire = 200,000 to 250,000 psi at normal temperature; coefficient of thermal expansion $\alpha = 4.3 \times 10^{-6}/°C$; at 800°C, for instance, tensile strength = 100,000 psi. Melting point: 3410°C. A 1°C decrease in temperature for a fixed length produces an increase of stress of 260 psi at room temperature, approximately in wire. However, this is for 100% bond. Since ceramic is still plastic but progressively less and less so as whole unit or wire alone cools after current or induction is cutoff, the coefficient of effective bond is less than 1. With good control of techniques here disclosed, efficiency of 50% can be achieved with minimum slip of wire. Therefore, after cooling from the melting point of mullite: fs = 0.5 × 1,850 × 260 = 240,000 psi; let effective metal stress be = 100,000 psi. Compressive strength = $f'_c$ = 20,000 psi; for instance, for impact and flexibility; fc = 0.3 × $f'_c$ = 6,000 psi.

Figure 4:
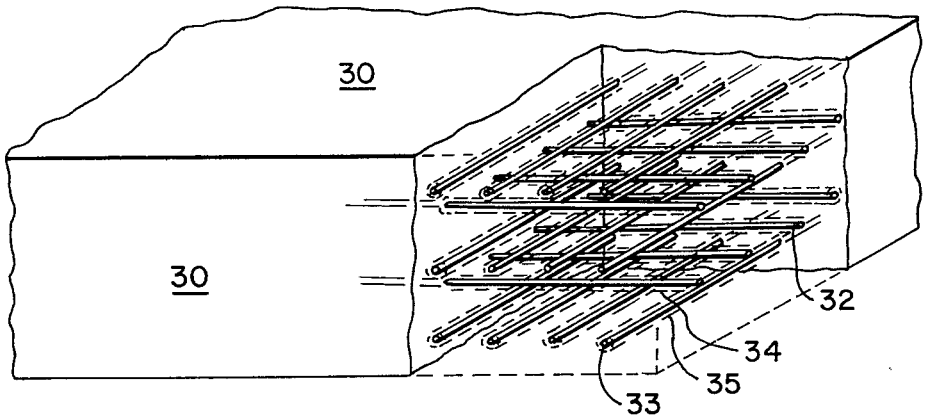
FIG. 4 is a cross sectional view of a plate made of ceramic material and prestressed in two directions according to the invention.

For the example of FIG. 3, a ceramic body wall thickness of 3/4 inches is selected to correspond to average conditions of use. In an element of one inch of length: Prestress/Area = P/A = 6,000 psi across section, hence: prestress = 6,000 × 0.75 × 4,500 lbs./in. for eccentricity of tendons in section $e = o$; and wires 1/16 inch diameter m: area = 0.0031 in². Prestress capacity per wire = 0.0031 × 100,000 = 310 lbs./wire. Number of wires required = 4,500/310 = 15 wires/inch, both ways. Spacing of wires = 3/16 inch c.c. in parallel rows. After the structure is formed as shown in FIG. 4, it is fired in the manner set forth in connection with the method of the invention or the wire grid is selectively heated and cooled to develop a prestressed ceramic shell which is placed in compression in two interacting directions. It should be noted that the tendons need not extend to the outer boundaries of the plate but may terminate within the body 30, as shown.

Prestressed Shell of Integrated Segments

Figure 5:
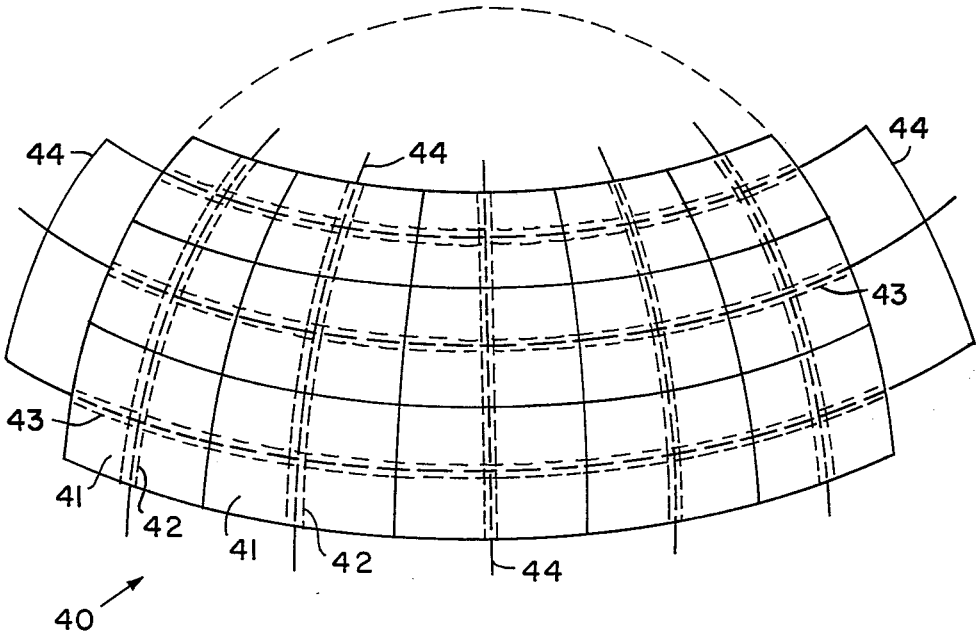
FIG. 5 is a perspective view of a shell made in accordance with the invention in which a plurality of segments are joined together and prestressed into an integrated structure having monolithic properties.

Referring to FIG. 5, there is shown a curved shell 40 which illustrates another application of the invention in which a plurality of segments 41 are integrated into a complete structure having monolithic properties. Thus, a plurality of polygonal plate-like segments 41 of ceramic material are made in the approximate shape of the respective segment that each will occupy in the completed structure. In the special case shown, each segment would have the shape of the portion of a spherical surface lying between its meridians and latitudes. A plurality of passageways 42, 43 are formed through the segments such that when the segments are assembled continuous passageways through adjacent segments is formed. As shown, such plurality of passageways 42, 43 can be arranged so as to cross each other in intersecting directions and can also pass centrally through the respective segment.

One or more prestressing tendons 44 is placed in each passageway and can serve to generally hold the structure together before prestressing. If required, a suitable fusible powder or slip material can be forced in any gaps between segments and around the tendons along the passageways to close the gaps between the segments and the tendons. If the passageways are approximately the same size as the tendons, the latter may be omitted.

Thereafter the assembled structure is treated in accordance with one of the selective heating or unit heating methods as previously described to thereby cause the tendons to become elongated with respect to the body and an anchorage bond to form between the tendon and the segments 43 or fusible material surrounding the tendons. As the tendons contract they apply prestress along their length being put in tension and cause the plurality of segments to be formed into an integrated structure having monolithic properties.

Since the structure has been formed from segments or smaller pieces of ceramic materials, such as polygons which can be of various shapes, it is significantly easier to manufacture from small pieces than if it were required to fabricate the shell as a unitary ceramic structure. Thus, the method and prestressed shell is of great value in making large structures of ceramics which will act monolithically. While special case of a segment of a spherical shell is shown for convenience of illustration, it will be understood that the resulting prestressed shell can be formed in other planar or curved configurations.

Materials

It is anticipated that a wide range of materials can be chosen for the body to be prestressed especially the so-called brittle materials which have poor tensile strength properties. These include the ceramics such as the oxides of aluminum, silicon, zirconium, thorium, hafnium, nickel, titanium, magnesium, beryllium, tantalum as well as their carbides, nitrides and borides, and combinations such as mullite. Kaolin or feldspar or mixtures thereof, clays containing kaolin or feldspar and which are common in the pottery and ceramic art, cordierites, fused quartz, are suitable. A ceramic material having a negative coefficient of thermal expansion, such as Eucryptite can be used to obvious advantage in the method and product disclosed herein.

In each of the foregoing there is a constituent in the material which reaches the fusion or softening temperature at some temperature less than the melting temperature of the tendon selected. If this is not the case, the region of the ceramic body surrounding the tendons can be formed of a separate material having a suitable fusion temperature. In order to carry out the foregoing, a passageway can be formed in the body for receiving the tendon. A packing of suitably fusible ceramic matter, such as a powder, is then used to fill the voids around the tendon, if required.

The tendons can be formed of a single strand of wire or multiple strands of wire, twisted or otherwise and/or in any of the usual forms. The tendon of course must possess substantial strength up to the fusion temperature of the ceramic. Suitable tendon materials include tungsten, molybdenum, chromium, zirconium, titanium, hafnium, rhenium, nickel and iron and their alloys such as nichrome. One highly suitable wire comprises a 90%–10% tantalum-tungsten wire.

With respect to metal wires, it is often necessary and desirable that the outer layer of the tendon be provided with a layer or coating which inhibits oxidation since certain ceramic materials may contain sufficient oxide component or free oxygen that are capable of reacting with the wire at high temperatures and thereby destroy its usefulness. Such coatings are selected from materials which do not melt or crack as the temperatures of fabrication. Examples of suitable coatings include the silicides of molybdenum, tungsten and columbium, and the aluminide of nickel.

By way of example, the wire can be provided with an anti-oxidant coating such as are commercially available as for example the chromatized coating described in the "Chromatized-Moly Wire" article disclosed in *The Iron Age* of Aug. 31, 1961. Also suitable are certain disilicide coatings such as are manufactured by the Chromalloy Corporation.

The following are examples of commercially available wire which is suitable for tendon materials to which the invention is directed. (a) 90%–10% tantalum tungsten coated wire with a Durak-MGF coating manufactured by the Chromizing Corporation of Hawthorne, California. This wire has a relatively ductile coat (to prevent breakage of the coating when the tendon changes dimensions) for protecting it against oxidation up to temperatures of 3700°F for short periods of time and can withstand temperatures of 2700°F under oxidizing conditions for up to approximately 180 hours. (b) Molybdenum wire coated with Chromizing Corporation's Durak-B. This wire displays a similar resistance to oxidation.

The particular temperatures to which the material immediately surrounding the wires is to be heated will directly depend upon the particular combination of body material ceramic or cermet and wire material selected. If desired for the purpose of increasing the prestress with a given combination of materials, the tandons can be extended far enough at either of the boundaries of the body so that the ends of the tendons can be gripped, as with wedges. Additional mechanical tension can then be placed on the ends of the tendons to assure that the tendons achieve a predetermined amount of elongation sufficient to subsequently apply the desired amount of prestress to the ceramic after the heating and bonding has taken place.

To keep the tendon from becoming fatigued after many cycles of heating and cooling in service, special alloys can be employed. For instances, the combination of 75% tungsten and 25% rhenium remains ductile after repeated cycles of heating and cooling. This material should be coated to prevent oxidation and is ideal for prestressing ceramics by the methods enumerated herein.

The following examples are set forth to illustrate the manner in which the invention was experimentally put into practice.

EXAMPLE 1.

In a preliminary experiment, a 4½ inch long wire of 0.045 inch diameter of 90/10 tantalum-tungsten composition coated with Durak-MGF was used as a string for nine ½ inch diameter ceramic (alumina and silica (or mullite)) beads having holes through the centers thereof. The nine beads, when strung together, had a total length of 3–3/4 inches. About 90 amperes of current at 6.3 volts were passed through the wire. The wire melted slowly through the ceramic beads with the center ones sinking faster and the wire approaching the tops of the center beads, the beads thus describing a catenary relative to the wire. When the current was stopped, the beads were drawn closely together and sufficient stress was applied to cause some of the beads to crack where the tops of the center beads underwent relatively large compressive stresses. Upon turning on the current again for short periods, expansion noises were heard. The tightening of the beads on the wire was apparent when the current flow was stopped. The experiment was terminated when the wire burned through the four center beads and became exposed at the top of these beads. As the wire emerged, it was completely coated with the melted ceramic and still adhered to the beads below. The original coating on the wire remained intact. Electric contact was achieved at will. There was no oxidation on the wires. The metal did not soften up and held the stress induced on cooling. The coefficient of thermal expansion of mullite is $5.3 \times 10^{-6}$ inch per inch per degree centigrade. That of 90/10 tantalum-tungsten is $6.3 \times 10^{-6}$.

EXAMPLE 2.

A length of the same type of wire as in Example 1 was strung with 14 similar beads. Above 80 amperes of current at 12.6 volts were passed intermittently through the wire for brief periods and it was observed that the assembly curved more as it cooled and straightened out somewhat when heated. The observed prestressing thus produced in the assembly a measurable camber and permitted a noticeable flexibility and toughness to be introduced without breaking the assembly or decreasing the tightness of the beads due to the elongation of the wire. This indicated that the assembly was prestressed and the beads not merely cemented together, and that the metal holds the stress and does not soften.

EXAMPLE 3

A ceramic is used consisting of kaolin (15%), Tennessee ball clay (40%), talc (10%), silica (14%), nephelene syenite (10%) (primarily silicate and aluminate) and 11% frit, (lead-monosilicate) by weight. 80% Cb-10% Ta-10%W alloy, coated with slurry aluminide ceramic is formed into beads with a central hole and heated as in Example 2.

Another method for obtaining a prestressed ceramic structure for use at high service temperatures can be developed from the teachings herein. Consider a body of ceramic material of the type previously disclosed. A tendon constructed of material having a thermal coefficient of expansion less than that of the body of the ceramic body is embedded and bonded therein. When this structure is subjected to the elevated temperatures in service, it will become prestressed at such temperatures since the tendon will be placed in tension by the bond existing along the length of the tendon and by the differential thermal expansion between the ceramic body and the tendon. By way of example, for a body of phosphate bonded zirconia preferably stabilized by calcia, having a coefficient of expansion of 11 to $15 \times 10^{-6}$ inches per inch per degree centigrade can be prestressed by tungsten wire which commonly has a coefficient of expansion of about $4.3 \times 10^{-6}$ inches per inch per degree centigrade.

From the foregoing disclosure it will be appreciated that many types and varieties of structures can be constructed utilizing brittle materials and cermets with greatly improved properties. Specifically, heat resistant portions of apparatus serving refractory purposes, missile parts and the like, civil engineering structures, pottery and many other common materials can be formed utilizing the invention. The process is particularly inexpensive and effective and produces a product with greatly enhanced properties and which carries no external mechanical stressing elements but rather can be trimmed to a neat finish.

To those skilled in the art to which this invention relates many modifications and adaptations of the invention will suggest themselves without departing from its spirit and scope.

For example, it is known that many ceramics can be formed into bodies by melting and pouring techniques, by sintering, by hot pressing, or flame spraying. All of these methods of forming ceramics are applicable to the general method of the invention, particularly the unit heating method. Thus, with the unit heating method a suitable grid or network of tendons can be constructed and molten or powdered ceramic poured about the network. By selecting the materials and following the teachings of the invention, an anchorage bond will be formed and prestressing will result. If sintering or hot pressing methods of ceramic powders is used to form the body, the tendon is selected to have a greater coefficient of thermal expansion than the body formed so that, upon cooling, contraction of the body places the tendon in tension. Accordingly, the disclosures, description and examples herein are to be taken as illustrative of the invention and not as a limitation thereon.

I claim:

1. A method for producing a prestressed ceramic body with an elongate tendon, comprising the steps of:

a. positioning said tendon in said body, said tendon having a greater coefficient of linear thermal expansion than the material of said body, b. elevating the temperature of said tendon and the region of said body immediately surrounding said tendon to at least the softening temperature of the material of the body so that said tendon elongates and undergoes differential thermal expansion with respect to said body, c. lowering the temperature of said tendon and the region of said body immediately surrounding said tendon so that said tendon contracts with a minimum degree of slippage with respect to said body during and after the resolidification of said region to thereby generate a bond stress anchorage between said tendon and said body to prestress said ceramic body, said tendon seeking to contract with respect to said body as a result of its greater coefficient of linear thermal expansion as respects said body, said bond stress anchorage developing the entire tensile force in said tendon.

2. The method of claim 1 wherein said step of elevating the temperature is carried out by selectively heating said elongate tendon within the body.

3. The method of claim 1 wherein said step of elevating the temperature is carried out by heating said elongate tendon and said body as a unit.

4. The method of claim 1 wherein said step of elevating the temperature is carried out before said ceramic body is formed and fired.

5. The method of claim 1 wherein said step of elevating the temperature is carried out after said ceramic body is formed and fired.

6. A method for producing a prestressed ceramic body with an elongate tendon, comprising the steps of:

a. positioning said tendon in said body, said tendon and said body each having a positive coefficient of linear thermal expansion, the coefficient of linear thermal expansion of said body being greater than that of said tendon, b. elevating the temperature of said tendon and region of said body immediately surrounding said tendon to at least the softening temperature of the material of the body so that said tendon elongates and undergoes differential thermal expansion with respect to unsoftened portions of said body, c. lowering the temperature of said tendon and the region of said body immediately surrounding said tendon so that said tendon contracts with a minimum degree of slippage with respect to said body during and after the resolidification of said region to thereby generate a bond stress anchorage between said tendon and said unsoftened portions of the body to prestress said ceramic body, said tendon seeking to contract with respect to said unsoftened portions of the body as a result of its linear thermal expansion with respect to said unsoftened portions of said body, said bond stress anchorage developing the entire tensile force of said tendon.

7. The method of claim 6 wherein said step of elevating the temperature is carried out by selectively heating said elongate tendon within the body.

8. A method for producing a prestressed ceramic body with an elongate tendon, comprising the steps of:

a. positioning said tendon in said body, said tendon and said body each having a positive coefficient of linear thermal expansion, the coefficient of linear thermal expansion of said tendon being comparable and not greater than the coefficient of linear thermal expansion of said body, b. elevating the temperature of said tendon and the region of said body immediately surrounding said tendon to at least the softening temperature of the material of the body so that said tendon elongates and undergoes differential thermal expansion with respect to unsoftened portions of said body, c. lowering the temperature of said tendon and the region of said body immediately surrounding said tendon so that said tendon contracts with a minimum degree of slippage with respect to said body during and after the resolidification of said region to thereby generate a bond stress anchorage between said tendon and said body to prestress said ceramic body, said tendon seeking to contract with respect to unsoftened portions of said body as a result of the positive linear thermal expansion of the tendon with respect to said unsoftened portions of said body as a result of the positive linear thermal expansion of the tendon with respect to said unsoftened portions of the body, said bond stress anchorage developing the entire tensile force of said tendon.

9. A method for producing a prestressed ceramic body with an elongate tendon, comprising the steps of:

a. positioning said tendon in said body, said tendon having a greater coefficient of linear thermal expansion than the material of said body, b. applying heat to said tendon and the entire body as a unit, the coefficient of liner thermal expansion of said tendon being greater than that of said body, to thereby elevate the temperature of said tendon and said body to at least the softening temperature of the material of the body, so that said tendon elongates and undergoes differential thermal expansion with respect to said body;

c. lowering the temperature of said tendon and said body so that said tendon contracts with a minimum degree of slippage with respect to said body during and after resolidification of said body to thereby generate a bond stress anchorage between said tendon and said body to prestress said ceramic body, said tendon seeking to contract with respect to said body as a result of its greater coefficient of linear thermal expansion as respects said body, said bond stress anchorage developing the entire tensile force in said tendon.

10. A method for producing a prestressed ceramic body with an elongate tendon, comprising the steps of:

a. positioning said tendon in said body, said tendon having a greater coefficient of linear thermal expansion than the material of said body, b. applying heat to said tendon and the region of said body immediately surrounding said tendon selectively, to thereby elevate the temperature of said tendon and said region to at least the softening temperature of the material of the body so that said tendon elongates and undergoes differential thermal expansion with respect to said body, c. lowering the temperature of said tendon and the region of said body immediately surrounding said tendon so that said tendon contracts with a minimum degree of slippage with respect to said body during and after the resolidification of said region to thereby generate a bond stress anchorage between said tendon and said body to prestress said ceramic body, said tendon seeking to contract with respect to said body as a result of its greater coefficient of linear thermal expansion as respects said body, said bond stress anchorage developing the entire tensile force in said tendon.

11. A method for producing a prestressed ceramic body with an elongate tendon, comprising the steps of:

a. positioning said tendon in said body;

b. positioning said tendon and the entire body in an oven, the coefficient of linear thermal expansion of said tendon being greater than that of said body to thereby elevate the temperature of said tendon and said body to at least the softening temperature of the material of the body, so that said tendon elongates and undergoes differential thermal expansion with respect to said body;

c. lowering the temperature of said tendon and said body so that said tendon contracts with a minimum degree of slippage with respect to said body during and after the resolidification of said body to thereby generate a bond stress anchorage between said tendon and said body to prestress said ceramic body, said tendon seeking to contract with respect to said body as a result of its greater coefficient of linear thermal expansion as respects said body, said bond stress anchorage developing the entire tensile force in said tendon.

12. A method for producing a prestressed body with an elongate tendon, comprising the steps of:

a. positioning said tendon in said body;

b. passing electric current through said tendon, to thereby elevate the temperature of said tendon and the region of said body immediately surrounding said tendon to at least the softening temperature of the material of said body, said tendon having a positive coefficient of linear thermal expansion as respects unsoftened portions of said body, and so that said tendon elongates and undergoes differential thermal expansion with respect to said body c. lowering the temperature of said tendon and the region of said body immediately surrounding said tendon so that said tendon contracts with a minimum degree of slippage with respect to said body during and after the resolidification of said region to thereby generate a bond stress anchorage between said tendon and said body to prestress said ceramic body, said tendon seeking to contract with respect to unsoftened portions of said body as a result of its positive coefficient of linear thermal expansion, said bond stress anchorage developing the entire tensile force in said tendon.

13. A method for producing a prestressed ceramic body with an elongate tendon, comprising the steps of:

a. positoning said tendon in said body;

b. positioning said tendon and the entire body in an oven, applying heat to said tendon and said body in said oven and causing electric current to flow through said tendon, then discontinuing applying heat to said tendon and said body in said oven and simultaneously maintaining said electric current flowing through said tendon, to thereby elevate the temperature of said tendon and the region of said body immediately surrounding said tendon to at least the softening temperature of the material of the body, said tendon having a positive coefficient of linear thermal expansion as respects unsoftened portions of said body, and so that said tendon elongates and undergoes differential thermal expansion with respect to said body;

c. lowering the temperature of said tendon and the region of said body immediately surrounding said tendon so that said tendon contracts with a minimum degree of slippage with respect to said body during and after the resolidification of said region to thereby generate a bond stress anchorage between said tendon and said body to prestress said ceramic body, said tendon seeking to contract with respect to unsoftened portions of said body as a result of its positive coefficient of linear thermal expansion, said bond stress anchorage developing the entire tensile force in said tendon.

14. A method for prestressing a body of ceramic or cermet material and the like using an elongate tendon extending therethrough, said tendon having a greater coefficient of linear thermal expansion than the material of said body, comprising:

a. positioning the tendon in the body;

b. heating the tendon and the region of the body immediately surrounding the tendon until the softening temperature of the body material is reached, and thereby causing the tendon to elongate with respect to the body;

c. cooling the tendon and the region of the body immediately surrounding the tendon to resolidify such region;

d. forming a bond stress anchorage directly between the body and the tendon during said step of cooling, said bond transmitting by means of anchorage bond stress the entire prestressing force between the body and the tendon; and e. further cooling the tendon to thereby tension the tendon and transmit the compressive force through said bond stress anchorage, whereby the body is prestressed.

15. The method of claim 14 wherein said step of heating comprises:

a. positioning the body in an oven; and b. heating the tendon and the entire body in the oven until the softening temperature of the body material is reached.

16. The method of claim 15 wherein the step of heating in an oven comprises firing the body.

17. The method of claim 14 wherein said step of heating comprises sintering.

18. The method of claim 14 wherein said step of heating comprises hot-pressing.

19. The method of claim 14 wherein said step of heating comprises applying heat to the tendon by causing electric current to flow through the tendon.

20. The method of claim 14 wherein said step of heating comprises applying heat to the tendon by an induction current.

21. The method of claim 14 further including:

a. positioning of the body and tendon in an oven subsequent to positioning the tendon in the body; and b. raising the temperature of the body and the tendon within the oven prior to the step of heating the tendon and the region of the body immediately surrounding the tendon, thereby reducing the risk of cracking or breakage of the body during said heating step.

22. The method of claim 21 further including:

a. allowing the body to cool to a lower temperature while maintaining the tendon at a high temperature by the step of heating the tendon.

23. The method as set forth in claim 14 including preforming a passageway through the body for positioning the tendon therein.

24. The method of claim 23 further including the steps of:

a. preforming a plurality of segments of ceramic material;

b. preforming a first plurality of aligned continuous passageways extending through each of said assembled segments;

c. preforming a second plurality of passageways, each of said second passageways extending through said assembled segments in a direction transverse to the direction of said first plurality of passageways;

d. assembling the segments into a desired configuration;

e. positioning one of a plurality of tendons longitudinally through one of each of said first plurality of passageways;

f. positioning one of a plurality of tendons extending longitudinally through one of each of said second plurality of passageways;

g. heating each of the tendons and the region of the body immediately surrounding the tendons until the softening temperature of the body material is reached;

h. cooling the region of the body immediately surrounding each of the tendons to resolidify such region and thereby establish an anchorage bond between the tendon and the body; and i. cooling each of the tendons to thereby contract the tendons and transmit a compressive force through the anchorage bond to apply therethrough the compressive prestressing force to the body, so that the application of compressive prestressing force to the body forms the plural assembled segments into an integrated monolithic prestressed ceramic body of desired configuration.

25. The method of claim 23 further including:

a. forcing a fusible material into gaps in the passageway between the tendon and the body, thereby closing said gaps as the fusible material solidifies during cooling of the tendon.

26. The method of claim 14 further including a. applying an oxidation inhibiting coating to the tendon prior to positioning said tendon in said body.

27. The method of claim 14 further including:

a. forming said tendon by twisting multiple wires into strands.

28. A method for forming a prestressed body of ceramic material for use in an elevated service temperature, comprising:

a. selecting a body and a tendon such that the tendon is constructed of a material having a coefficient of linear thermal expansion smaller than that of the material of the body;

b. positioning the tendon in the body;

c. bonding the tendon to the body; and d. elevating the body to a service temperature, thereby causing the body to expand relative to the tendon and become compressed by the tendon.

29. A method for prestressing a body of ceramic or cermet material and the like with an elongate tendon extending therethrough, said material and tendon being selected so that when said material is softened under heat it will fuse to the tendon on resolidifying, comprising the steps of:

a. positioning said tendon in said body;

b. heating said tendon and at least the region of said body immediately surrounding said tendon as a unit in an oven;

c. selectively heating said tendon by causing electric current to flow through the tendon until said region softens;

d. subsequently discontinuing heating the tendon and at least the region of said body immediately surrounding the tendon as a unit;

e. simultaneously with said step of discontinuing, maintaining said tendon and the region of said body immediately surrounding said tendon selectively heated, thereby expanding said tendon with respect to said body;

f. subsequently cooling said tendon and said region until material in said region resolidifies and fuses directly to said tendon;

g. forming a bond stress anchorage to the outer wall of said tendon at least at each end thereof, said anchorage being capable of transmitting the entire prestressing force between the body and the tendon through bond stress; and h. subsequently further cooling said tendon and region to thereby tension the tendon through said bond stress anchorage at each end thereof and apply a corresponding compressive prestressing force to said body.

30. The method of claim 29 wherein said step of heating said tendon and said region as a unit is carried out before the firing of said body.

31. The method of claim 29 wherein said step of heating said tendon and said region as a unit is carried out after the firing of said body.

32. The method of claim 29 further including:

a. applying an oxidation inhibiting coating to the tendon prior to positioning said tendon in said body.

33. The method of claim 29 further including:

a. forming the tendon by twisting multiple wires into strands.

* * * * *